US005588238A

United States Patent [19]

Visocky et al.

[11] Patent Number: 5,588,238

[45] Date of Patent: Dec. 31, 1996

[54] SIGN COMPRISED OF A CARRIER FRAME AND MANUALLY ARRANGEABLE MODULAR INFORMATION GRIDS AND PICTORIALS

[75] Inventors: Joseph E. Visocky, Racine; Everett Evans, Hales Corners, both of Wis.

[73] Assignee: Everbrite, Inc., Greenfield, Wis.

[21] Appl. No.: 490,470

[22] Filed: Jun. 14, 1995

[51] Int. Cl.$^6$ ..... G09F 7/02

[52] U.S. Cl. ..... 40/618; 40/575; 40/611

[58] Field of Search ..... 40/489, 490, 491, 40/575, 576, 611, 618

[56] References Cited

U.S. PATENT DOCUMENTS

| | | | |
|---|---|---|---|
| 1,120,876 | 12/1914 | Witz | 40/576 |
| 1,403,669 | 1/1922 | Chouinard | 40/490 X |
| 1,644,742 | 10/1927 | Moynihan | 40/576 |
| 1,840,729 | 1/1932 | MacKintosh | 40/489 X |
| 4,425,727 | 1/1984 | Waldekrantz | 40/611 X |
| 4,593,486 | 6/1986 | Visocky et al. | 40/490 |
| 4,991,334 | 2/1991 | Amundsen | 40/575 X |

*Primary Examiner*—Brian K. Green
*Attorney, Agent, or Firm*—Ryan, Maki, Mann & Hohenfeldt

[57] ABSTRACT

A sign or menu board has a pair of parallel vertical side rails with opposite end portions of upper and lower cross rails joined to the upper and lower end portions of the side rails to form a carrier frame. Each side rail has a track coextensive with its length. Grid modules make up modular grid units. Each unit, which may contain only one module, is comprised of cross bars that are joined at their opposite ends by tie-bars which together with the cross bars define a window opening. The cross bars are provided with lengthwise grooves for slidably accepting an information strip between them. The grid units slide into the carrier frame along the tracks and are constructed such that the information strips can be slid into or out of a grid without withdrawing the grid from the carrier frame. Pictorial assembly retainer bars are also constructed for sliding into the frame on the side rails. The laterally extending retainer bars are slotted to receive the upper and lower edges of a pictorial composite composed of a transparency between two light transmissive plastic panels. Pictorials are exchangeable without necessitating removal of a pictorial assembly from the carrier frame.

8 Claims, 5 Drawing Sheets

SIGN COMPRISED OF A CARRIER FRAME AND MANUALLY ARRANGEABLE MODULAR INFORMATION GRIDS AND PICTORIALS

BACKGROUND OF THE INVENTION

The invention disclosed herein pertains to a sign that is useful to display menu items in places such as in fast food restaurants, for example, although the sign has many other point-of-purchase applications as well. The new sign is particularly advantageous where prices and the names of items on display at the point-of-purchase may be updated frequently and/or where the merchant would appreciate being able to produce different effects with a sign as opposed to being restricted to using it in a single dedicated manner.

SUMMARY OF THE INVENTION

An important objective of the invention is to provide a sign which employs a basic carrier frame and allows changing of the order of presentation of menu line items and point-of-purchase pictorials; and, further, provides for easily adapting to different sizes of transparencies and pictorials and to various combinations of menu line items too.

Another objective of the invention is to provide a basic carrier frame for a sign that allows for use of modular grids to obtain total flexibility in locating menu items and point-of-purchase information in a menu board sign system without the need for a merchant to purchase new complete menu grids or point-of-purchase signs when refreshing a sign board is desired.

Another objective of the invention is to enhance customer satisfaction by providing a less costly and more versatile sign or menu board that provides for updating of existing sign displays in the field, eliminates the need for engraved custom header strips, can be retrofitted to indoor and outdoor menu boards and can easily be changed, substituted or rearranged in the field.

Briefly stated, the new sign carrier system frame comprises laterally spaced apart vertical or longitudinally extending grid guide rail members that have tracks and are joined at their upper and lower ends by laterally extending cross rails to form a rigid permanent carrier frame. Modular information grid units are adapted to slide on the guide rails, one after another to span across the space between the vertical guide rails of the carrier frame. The grids are provided with windows and are adapted for having information strips inserted in them from their edges, that is, without removing the grids from the carrier frame so that information such as the names of items and their prices can be illuminated from the rear. Provision is made for inserting, along with the grids, holding members for pictorials. A pictorial is, in this case, a film transparency that is insertable between a rear transparent backing window panel and a front transparent protective window panel.

Every grid unit is comprised of one or more grid modules so one grid module may be perceived as a grid unit, too. Every grid module has a window for accommodating a back-lighted information strip. A grid unit will have an integer number of grid modules and, therefore, will have an integer number of windows for information strips. A grid module has a basic reference height and all grid units have a height dimension that is a multiple of the basic height. This makes it possible for the total height of the modular grid units to come out even with the height or longitudinal dimension of the carrier frame for any combination of grids or grid units. In any case, each modular unit of a grid contains a window that extends across the width of the carrier frame and is provided with appropriate channels for receiving the information strips which a merchant might want to display.

How the foregoing general features and other specific features of the invention are implemented will be evident in the ensuing more detailed description of a preferred embodiment of the invention which will now be set forth in reference to the accompanying drawings.

DESCRIPTION OF A PREFERRED EMBODIMENT

Figure 1:
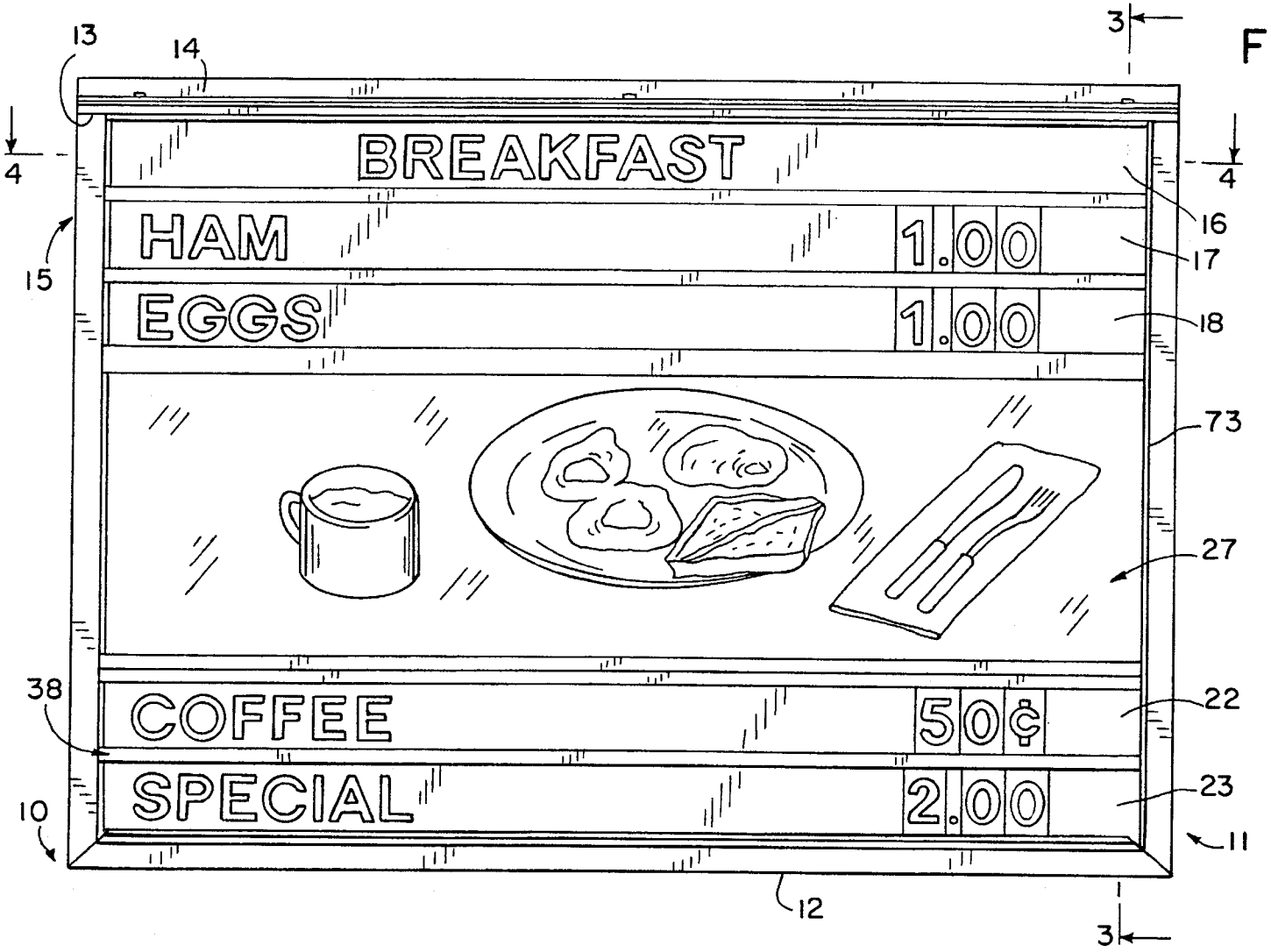
FIG. 1 is a front elevational view of the new carrier system sign assembly in which a plurality of information grids and a pictorial are presently installed to form a sign such as a menu board that can be illuminated from its rear.

FIG. 1 shows an assembled sign carrier system that is suitable for being subjected to rear natural or artificial illumination so it can be read by a viewer looking at its front. Briefly outlined, the system has a carrier frame comprised of left and right extruded longitudinally extending side rails which are generally designated by the numerals 10 and 11. The side rails, as will be demonstrated later, are also guide rails in that they each have a coextensive track that provides for sliding modular grid units into and out of the frame. The two side rails are joined at their bottom end by a cross rail 12 which, not only serves to stiffen the carrier frame but acts as a stop for grids that are inserted in the frame as will be described in detail subsequently. The basic frame also comprises an upper cross rail 13 whose left and right ends are joined with the upper ends of the side rails 10 and 11. The rigidly fixed cross rail 13 has a trim rail 14 releasably fastened to it to give the carrier frame an appearance of symmetry and good aesthetic quality and also to discourage any unauthorized attempt to withdraw the grids and other elements inserted between the vertical guide rails out of the frame.

Figure 2:
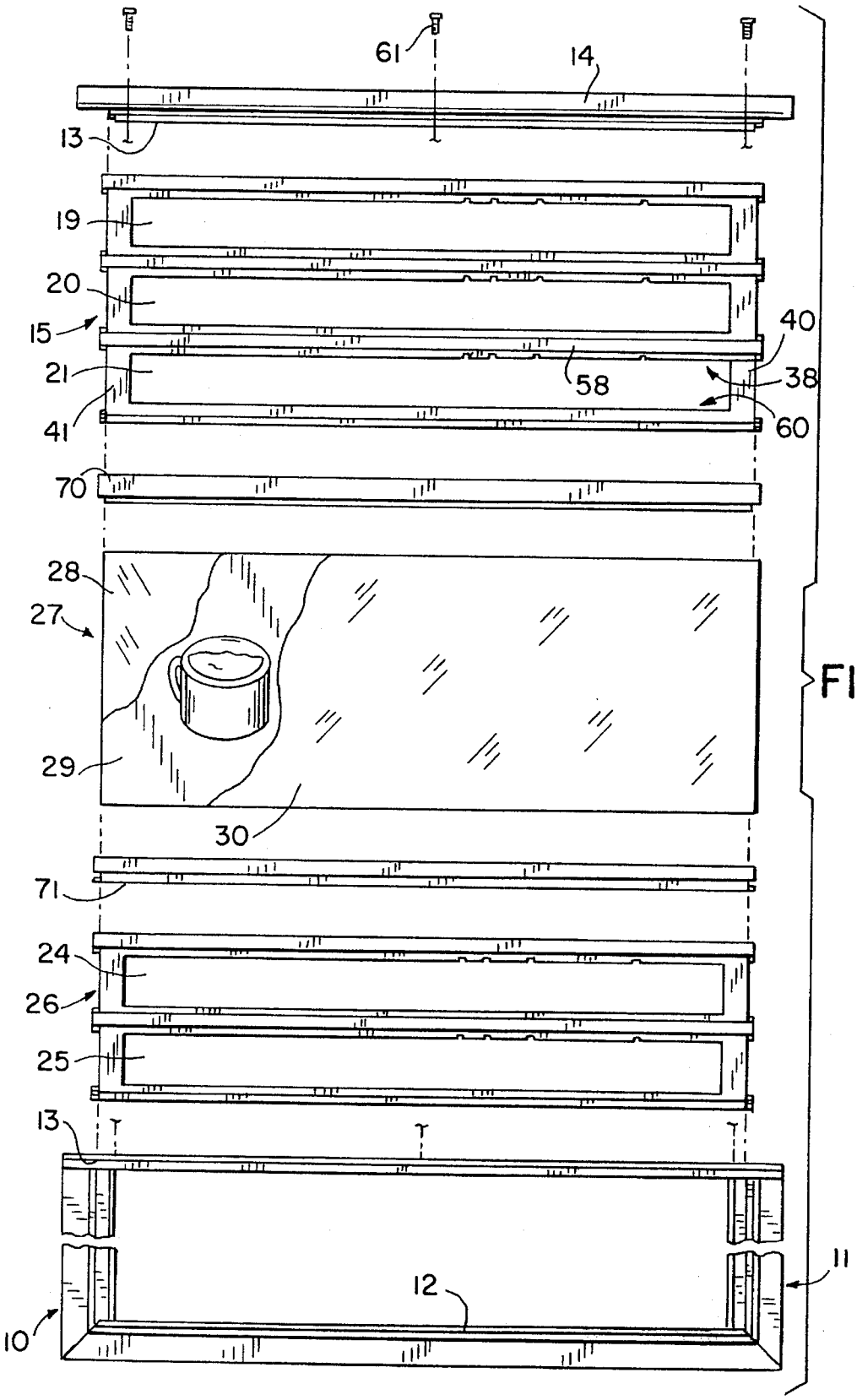
FIG. 2 is an exploded front elevational view for demonstrating how the grids and parts for mounting pictorials are assembled in the carrier frame.

In the FIGS. 1 and 2 embodiment, one three-window grid unit 15 and a two-window grid unit 26 are in use. The three-window grid unit 15 is shown isolated and in more detail in FIG. 2. Grid units, such as grid unit 15 or grid unit 26 in FIG. 2, are comprised of modular grids. Although a single basic grid module is not shown in a front view in the drawing, such basic grid module will be broken away verbally from the three-module grid unit 15 in FIG. 2 for the sake of defining a basic grid module. A grid module is comprised of one upper cross bar 38, a lower cross bar 60 and two end tie bars 40 and 41 that join the cross bars together to provide a window opening 21. Where a grid unit is made up of more than one basic grid module as is grid unit 15 in FIG. 2, there are three upper cross bars, considering bar 38, and the two bars above it. They all have the same cross sectional configuration and all have a flat part 58 defining a channel or groove, shown later, and serving as a guide for slidably receiving an information strip such as strip 22 in FIGS. 1 and 10. The cross sectional configuration of the lower cross bar 60, as will be shown later, differs from an upper cross bar 38. Even though the lower cross bar 60 has no guide channel for receiving an edge of an information strip, it will be evident that when the lower cross bar 60 of one grid is stacked on the upper cross bar 38 of a subjacent grid, the subjacent grid upper cross bar defines one of two channels needed to hold an information strip. The grids and carrier frame parts are preferably aluminum extrusions. In FIG. 1, one may see that one of the grids has a strip inserted in it which displays the word "Breakfast." The strip is marked 16. The background of the strip, for example, may be opaque and the word "Breakfast" may be translucent. Generally, these strips are made using screen printing methods. In FIG. 1 another one of the strips 17 in the three module grid unit displays the word "Ham" along with an arbitrary price and a third one of the strips 18 in the three-module unit grid displays the word "Eggs" and an arbitrary price.

A typical information strip such as the one marked 16 in FIG. 1 will fit over a window 19 in the uppermost of the grid window units in FIG. 2. Similarly, in the case of a three-module grid unit, strip 17 of FIG. 1 would fit over window 20 and information strip 18 would fit over window 21. Similarly, information strips 22 and 23 in FIG. 1 would fit over windows 24 and 25 in the two unit grid which is generally designated by the numeral 26 in FIG. 2. The pictorial, which is generally designated by the numeral 27 in FIG. 1, is similarly generally designated in FIG. 2 to which attention is now invited.

The pictorial assembly 27 in FIG. 2 comprises a transparent, preferably plastic window material 28. The components such as the cup being pictured are photographic transparencies but other types of transparencies may also be used. The transparency is protected by a transparent front window panel 30. It should be evident that the transparency 29 is thus sandwiched between transparent window panels 28 and 30.

In the lowermost portion of FIG. 2 the carrier frame is shown broken into two parts which, as has been mentioned previously, include a left side rail 10, a right side rail 11, a bottom cross rail or grid stop 12 and a top cross rail 13. These parts comprise the basic carrier frame. The cross sectional configuration of side rails 10 and 11 is revealed in FIG. 4. Typical side rail 10 is a straight extruded vertically or longitudinally extending member that is formed in part to create a long vertically extending opening 35 constituting a track, defined by the guide rail walls 31,32 and 33. A flange 37 is extruded integrally with guide rail walls 31, 32 and 33. Flange 37 is for improving the aesthetic quality and trim of the side rail members and the flange is also useful for setting the sign assembly in a light-box, not shown, to provide for illuminating the sign from its rear so the legends on the information strips and the pictorials can be viewed during the day or night. A grid that contains an information strip 16 is shown positioned in the side rails 10 and 11 in FIG. 4. The U-shape of the side rails 10 and 11 not only defines a track but also serves to prevent light from leaking around the information strips from a light source, not shown, at the rear of the sign to the front of the sign.

Figure 4:
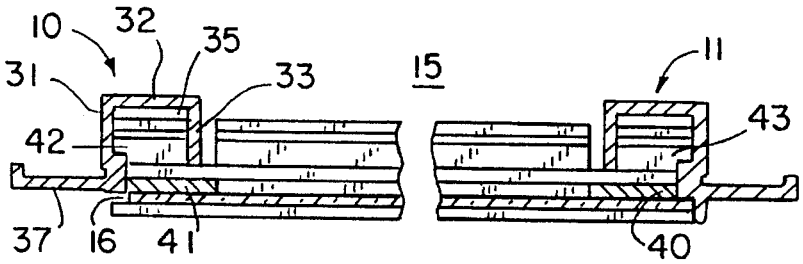
FIG. 4 is a transverse section taken on a line corresponding to 4—4 in FIG. 1.
Figure 5:
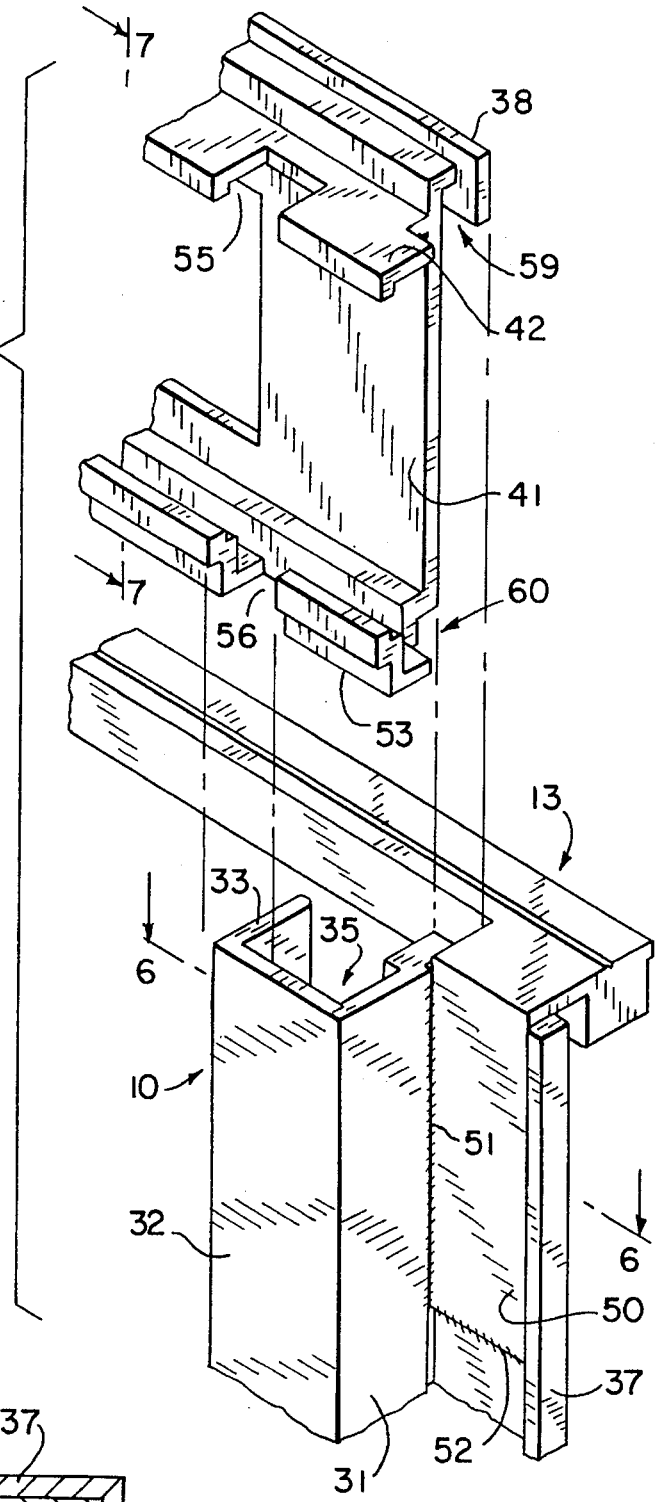
FIG. 5 is a fragmentary exploded view showing how the rear side of the end of the grid modular units of a grid is configured for being inserted into the upper end of one of the laterally separated pair of longitudinally extending grid guide rail members of the carrier frame.

The manner in which a modular grid fits and slides into the side rails is shown in substantial detail in the FIG. 5 fragmentary and exploded view and in FIG. 4 too. In FIG. 5, the walls of the longitudinal guide rail 10 vertical tracks are marked 31, 32 and 33 as in FIG. 4. The flange, which is integral with the guide rail portion and is extruded with it is marked 37 as it is in FIG. 4. The upper cross rail is indicated generally in FIG. 5 by the numeral 13 as it is in FIG. 2. As is evident, the ends of the upper cross rail 13 of the carrier frame are provided with a flat vertical tab 50 which is for tying in the upper cross rail 13 with the vertically extending flange 37 of the extruded vertical guide rail. Tab 50 can be fastened to the flange 37 in a variety of ways including rivets and bolts, not shown, but in the illustrated example the edges are welded as indicated at 51 and 52, for example.

In the upper part of FIG. 5, a typical grid is about to enter the guide rail space or track 35 for guidance into the carrier frame. As in FIG. 4, the back of the vertical tie-in part 40 of the grid has an upper slider portion or track follower 42 extending rearwardly of it. It is configured, as previously mentioned, to complement the shape of the guide rail track opening 35. Track follower 42 is adjacent a notch 55 that avoids interference by sidewall 33 of the track 35. Also, the grid has a lower track follower 53 extending rearwardly. It also is configured to fit complementarily in the guide rail or track 35. Every one of the grid units whether it be a single or a multiple window unit is provided with slots such as the slots marked 55 and 56 in FIG. 5, into which the track side wall 33 extends to assure that there can be no improper lateral shifting of a grid unit that is set in the vertical guide rails. It is especially noticeable in FIG. 5 that the upper cross member 38 of the grid has an integrally extruded T-shaped facing element member, marked 58 as is typical of the grid in FIG. 1 where a similar element appears as a rectangle. Referring to FIG. 5 one may see that the facing element 58 is spaced outwardly to define a groove 59 that extends across the upper cross bar 38 of the grid and is adapted for accommodating the upper edge of a typical information bearing strip such as the strip marked 16 in FIG. 1. Also, a lowermost edge of any of the single, double or triple window grid units is terminated in a laterally extending saddle configuration such as the one marked 60 in FIG. 5. A section is taken in FIG. 7 to show the configuration of the lower cross bar 60 of a single window grid, for example stacked on the upper cross bar of a subjacent single window grid.

Figure 6:
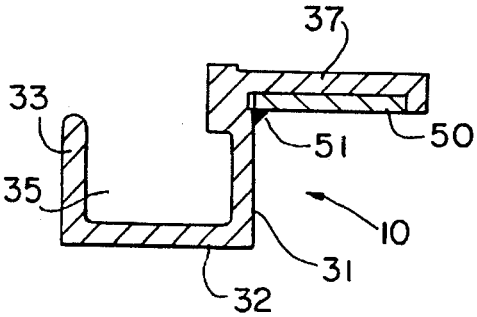
FIG. 6 is a transverse section of one vertical guide rail taken on a line corresponding to 6—6 in FIG. 5.

A section of the vertical guide rail 10 in FIG. 5 is depicted in FIG. 6 where the parts are given the same reference numerals. The configuration in FIG. 6 is self evident and requires no further description.

Figure 3:
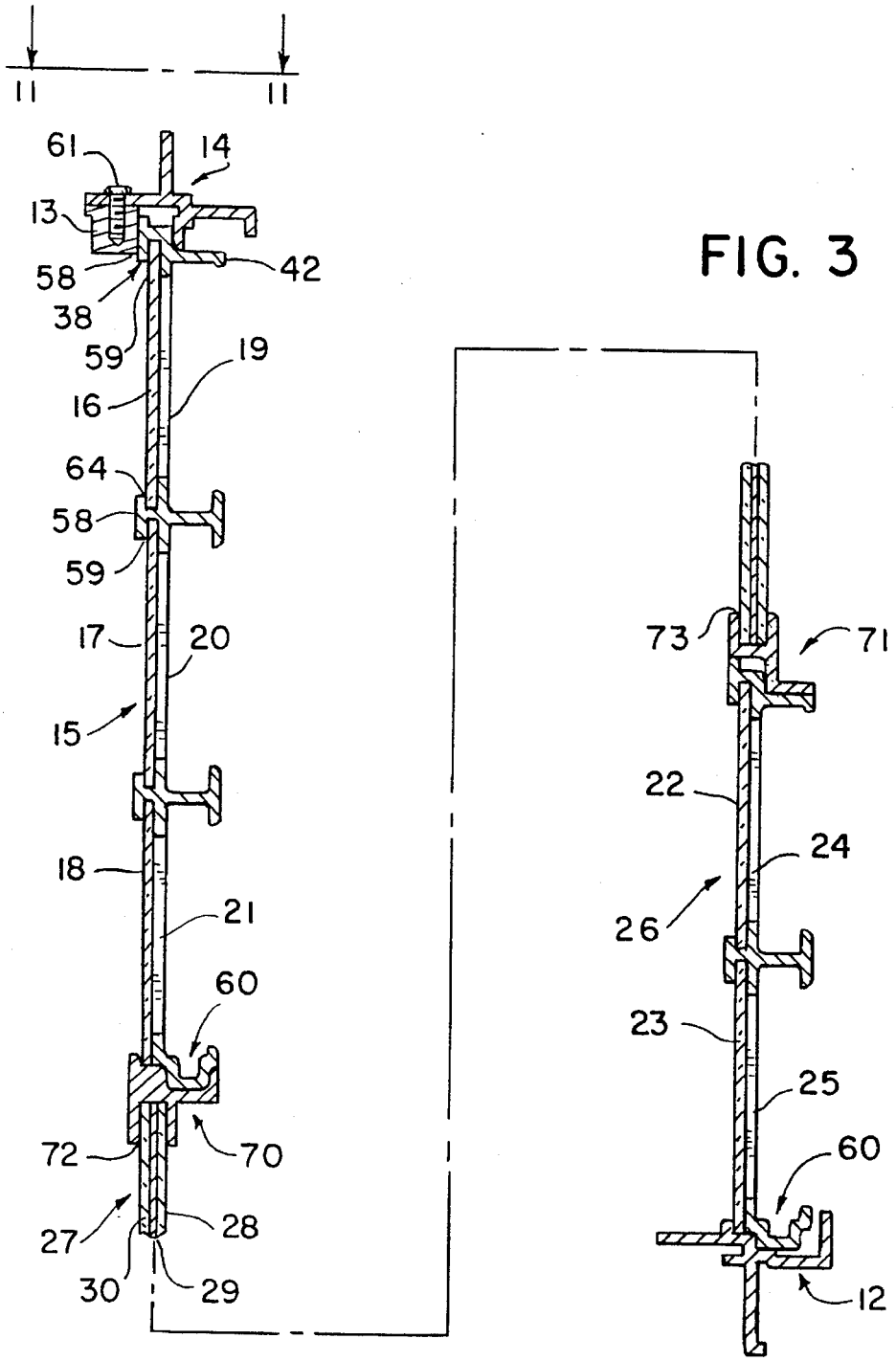
FIG. 3 is a vertical section taken on a line corresponding to 3—3 in FIG. 1.

The FIG. 3 sectional view shows how the grids and a pictorial are arranged in correspondence with the particular FIG. 1 arrangement. In FIG. 3, the uppermost information window 19 of the grid contains information strip 16. The grid upper cross bar 38 is captured by the trim strip 14 which has been identified earlier in reference to FIGS. 1 and 2. The upper cross bar 13 of the carrier frame appears in section but, as previously explained, its opposite ends are attached permanently to the vertical side rails 10 and 11 of the carrier frame. The trim strip 14 is fastened to cross bar 13 of the carrier frame by means of a plurality of screws such as the one marked 61. It is evident in FIG. 3 that facing elements 58, have lateral grooves 59 into which the top edge of information strips such as the one marked 16 are slid. Even when the sign is completely assembled as is the case in FIG. 1, any one of the information strips 16, 17, 22 or 23 can be slid sideways out of any one of the grids and replaced by another information strip if desired. This will be discussed in more detail in reference to FIG. 10 later.

Figure 7:
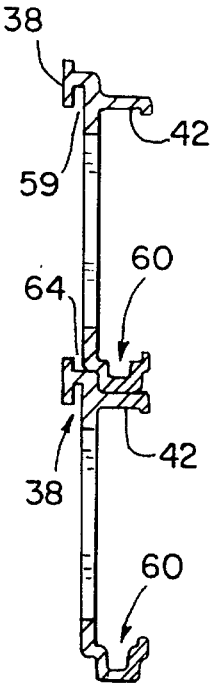
FIG. 7 is a vertical section of a single basic grid taken on a line corresponding to FIG. 7—7 in FIG. 5, the section having been taken at a place away from the guide rail engaging end of the grid and the grid is superimposed on a subjacent grid which is also shown in section.

In FIG. 3, one may observe that the lowermost portion of the grid module containing information strip 18 is terminated at its lower extremity with a laterally extending cross bar element which is designated by the numeral 60 in FIG. 3. In fact, all of the single window grid modules and all multiple window grid units are terminated at their bottom edges, respectively, in this manner regardless of whether they are single, double or triple window or other multiple window grids. This is further illustrated in FIG. 3 in the grid containing information strips 22 and 23 which terminates in the configuration under discussion so it is similarly marked 60 for consistency. The lower grid cross bar 60 is functional. As shown in FIG. 7 it provides for complementing the configuration of the upper cross bar 38 of any of the other single or multiple window grid units. Thus, when two grids are stacked, as they are in FIG. 7, the lower of the two grids provides one of the elements 58 of upper cross bar 38 that allows development of a slot 64 in conjunction with the other one of the grids for accommodating a laterally slidable information strip. Refer again to FIG. 3 for a more detailed discussion of the manner in which the pictorial assembly 27 is implemented. First of all, observe that upper and lower laterally extending pictorial retainer bars 70 and 71 are provided for mounting and retaining pictorial assembly 27. Retainer bars 70 and 71 have suitable slots 72 and 73 in which the edges of the window panels 28 and 30 with the transparency 29 sandwiched between them reside. The two lateral retaining bars 70 and 71 are also depicted in FIG. 2. Their ends are configured similarly to the ends of the grids, as previously described in reference to FIG. 5, so that they can slide down the tracks 55 of vertical guide or slide rails 10 and 11 like a grid. The back up window panel is marked 28, the front window panel is marked 30 and the transparency is marked 29.

Figure 10:
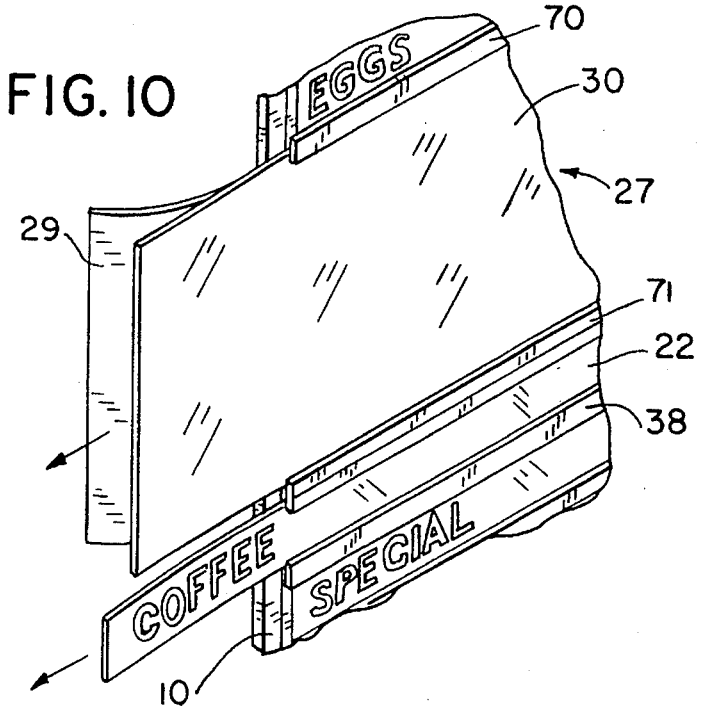
FIG. 10 is a fragmentary detail showing how pictorials and information strips may be installed and exchanged without withdrawing the grid and supports for the pictorials from the carrier frame.

FIG. 10 shows how an information strip 22 or a pictorial assembly 27 can be removed or inserted without the need for withdrawing any of the grids or support members 70 and 71 for the pictorials from the basic carrier frame. If there is a desire to substitute a new pictorial, it will be evident in FIG. 10 that it is only necessary to pull out the front window panel 30 from between cross members 70 and 71 and, at the same time, withdraw the transparency 29 while, if desired, leaving the back window panel 28, not visible, in FIG. 10 stay in place. After that, a replacement transparency 29 can be slid in the grooves of the cross bars 70 and 71 followed by replacing the front transparent panel 30 in the same manner. Replacing an information strip such as the one marked 22 in FIG. 10 is a simple operation. It is only necessary to frictionally engage the end of the strip with a finger and slide it out from between lower cross bar 71 for the pictorial and upper cross bar 38 of the next lower grid module. The grid window is then unoccupied for insertion of a substitute information strip 22. Although in the demonstration sign, the information strips and pictorial elements can be withdrawn and inserted from the left side of the assembled carrier frame, withdrawal of the information strips and pictorial components can not be accomplished from the right side of the carrier frame. In other words, the right vertical guide rail 11 is provided on its front face with a small riser or ledge 73 as shown in FIG. 1. This ledge is coextensive in length with side rail member 11 and is extruded as part of the side rail. The ledge acts as a stop for the information strips and pictorial components. Ledge 73 has no counterpart on the left extruded guide rail 10.

Figure 9:
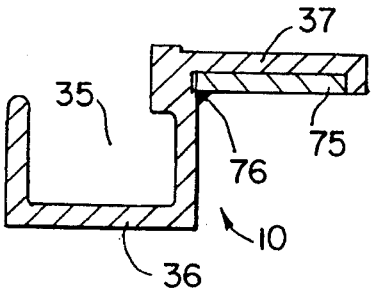
FIG. 9 is identical to FIG. 6 except that the FIG. 9 section is presented next to FIG. 8 to aid in interpreting FIG. 8.
Figure 8:
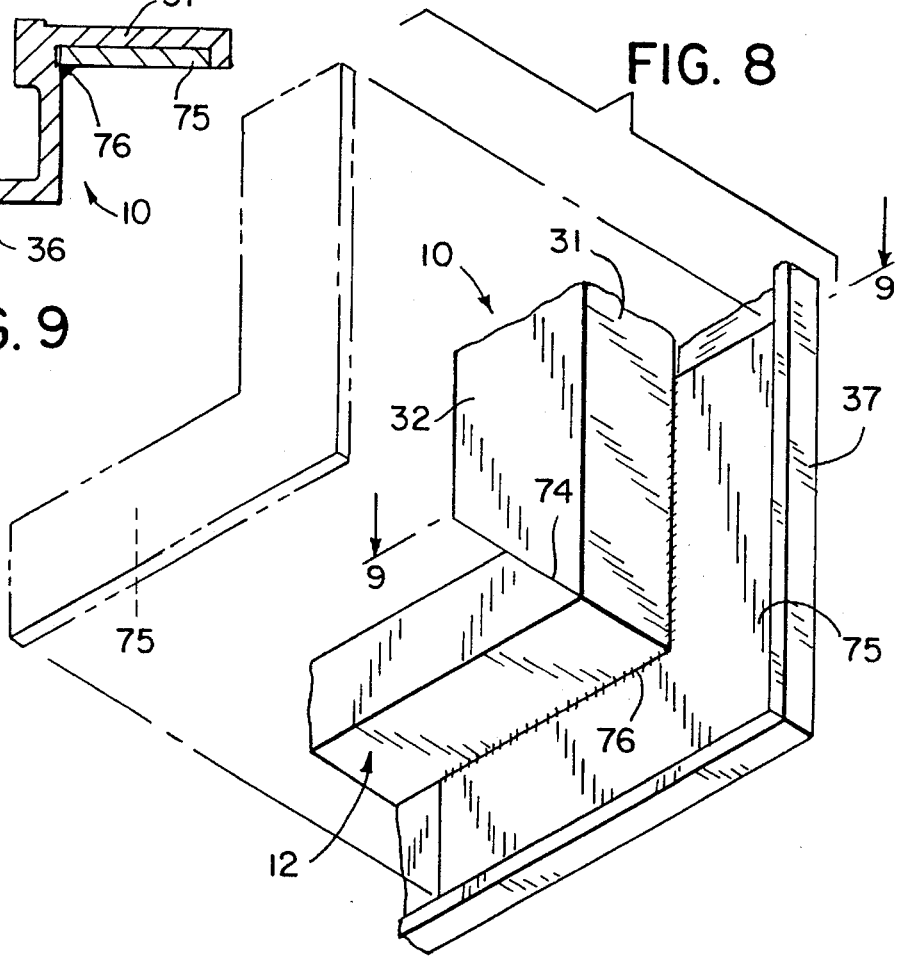
FIG. 8 is a fragmentary perspective view of a lower rear corner of the carrier frame showing how a vertical side rail terminates at its lower end and abuts the end of the bottom cross rail of the carrier frame such that the two ends can be secured together in this embodiment by means of an L-shaped member having one leg welded to the side rail end and the other welded to the bottom cross rail end.

FIG. 8 illustrates how a bottom cross rail 12 of the carrier frame is joined with the vertical guide rails. One may see by looking at the rear of the frame that the horizontal cross member 12 and left vertical guide rail 10 abut along an angular parting line 74. An L-shaped member 75 is designed to interface with typical vertical guide rail 11. L-shaped member 75 is welded to guide rail 11 as well as to its laterally extending flange portion 37. The weld is symbolized along the line 76. The L-shaped member is depicted in isolation FIG. 9 shows how the L-shaped member 75 nests in the recess of flange 37 of guide rail 11. A fillet weld 76 is indicated in FIG. 9. It should be apparent that L-shaped member 75 could be riveted or bolted to flange portion 37, instead.

FIG. 2 shows in its bottom region a compressed view of the basic carrier frame comprised of left guide rail 10, right guide rail 11, upper cross bar 13, and lower cross bar 12 of the carrier frame. The user composes a sign by selecting appropriate modular grids, grid units and pictorial sizes. Carrier frames of various sizes can be provided. In this particular example, the first grid unit that would be slid into the guide rails is the one marked 26. This just happens to be the grid unit that accommodates two information strips because the grid is composed of two basic grid modules and therefore has two windows 24 and 25. After grid unit 26 descends to a resting position against bottom cross rail 12, a bar 71 for supporting the pictorial is slid down the tracks 35 of guide rail for it to come to rest on the top of grid 26. This cross bar 71 is so configured that it interlocks with the top edge of grid 26 as can be seen also in FIG. 3. The user now has the option of inserting upper cross bar 70 for the pictorial such distance into the carrier frame that there is space between upper cross bar 70 and lower cross bar 71 for inserting the transparent windows and transparency edgewise of the carrier frame so that the composite of the rear window panel 28, transparency 29 and front window panel 30 become captured between the cross bars 70 and 71 as has been shown in FIG. 3. Then, the three module grid unit 15 can be inserted in the guide rails for it to slide down and make contact and interlock with cross bar 70. After that, trim bar 14 can be put in place and secured with screws 61 to the carrier frame upper cross bar 13. Thus, all elements of the sign are locked in place by the trim bar 14.

It should be understood that a double window grid unit such as the one marked 26 in FIG. 2 is exactly double the height of a basic single window grid module such as either one depicted in FIG. 7. Likewise, a three window grid 15 is three times the height of a single window module grid. Thus, it will be evident that in place of the double window grid 26 in FIG. 2 two of the single window grids could be used. Similarly, the three window grid unit 15 could be replaced by one single window grid and one double window grid. Moreover the pictorial can be located practically anywhere the user chooses. To show the flexibility of the system, one might choose to have a single window grid instead of the double window grid as the lowermost grid in the carrier frame. This choice might be made because of the desire on the part of the user to lower the pictorial in the carrier frame for aesthetic reasons or make it more attention getting because of it being closer to the level of the visualizers eyes. If a single window had replaced double window grid 26 then, of course, it is necessary to make up for the loss in distance by substituting or adding another single window grid, possibly directly above the pictorial. The point is, an arrangement of the grids and the pictorials are options that are made available to the user as opposed to conventional dedicated or fixed design menu boards which are commonly used at present.

Figure 11:
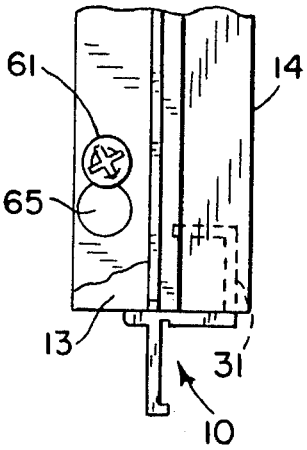
FIG. 11 is a fragmentary top plan view taken on a line corresponding to 11—11 in FIG. 3.

FIG. 11 shows how trim rail 14 is releasably fastened to upper cross rail 13 of the carrier frame. Trim rail 14 has a key hole 65 which narrows under the head of screw 61. The trim rail 14 is placed on cross rail 13 with the head of screw 61 extending through the large part of key hole 65 while the screw is backed off slightly. The trim rail is then slid so the small part of the key hole is under the screw head. The screw 61 is then tightened into cross rail 13.

Although a preferred embodiment of one size of the new sign has been described in detail, such description is intended to be illustrative rather than limiting, for the invention may be variously embodied and is to be limited only by interpretation of the claims which follow.

I claim:

1. A sign system comprising:

a carrier frame including longitudinally extending side rail members that have nominally upper and lower end portions and are laterally spaced from and parallel to each other, upper and lower cross rail members extending laterally between the side rail members and each cross rail member having opposite ends, the opposite ends of the upper cross rail member joined with the upper end portions, respectively, of the side rail members and the opposite ends of the lower cross rail member joined with the lower end portions, respectively, of the side rail members to thereby define a rigid carrier frame, said side rail members having guide tracks substantially coextensive with the length of the side rail members, at least one grid unit comprised of at least one grid module including upper and lower laterally extending parallel longitudinally spaced apart cross bars having opposite corresponding ends and laterally spaced apart longitudinally extending tie bars at each end rigidly connecting corresponding ends of the cross bars to thereby define a window opening, and said ends of the cross bars for each grid module are configured for engaging with said guide tracks at said upper ends of the side rail members to provide for sliding said grid unit in the carrier frame for being retained between the side rail members and, upper and lower pictorial assembly retainer bars each having opposite end portions configured for sliding on said tracks of said side rail members into the carrier frame for being arranged in longitudinal spaced apart relationship, the upper retainer bar having a downwardly presented slot and the lower retainer bar having an upwardly presented slot, and, a pictorial assembly comprised of front and rear light transmissive panels and a transparency panel disposed between said panels, said panels having corresponding upper edges of registering in the slot of the upper retainer bar and having corresponding lower edges for registering in the slot of the lower retainer bar for holding the pictorial assembly in the carrier frame.

2. A sign according to claim 1 wherein:

said upper retainer bar also has an upwardly presented slot and the lower cross bar of a grid module of a grid unit stacked on the upper retainer bar has a cross sectional configuration complementarily shaped to the upwardly presented slot for the lower cross bar of the grid unit to nest in the slot.

3. A sign according to claim 1 wherein:

said lower retainer bar of the pictorial assembly has a cross sectional configuration opposite of said downwardly presented slot thereof for engaging in a substantially complementary fashion the upper cross bar of a grid module of a grid unit on which said pictorial assemble is stacked.

4. A sign system comprising:

a carrier frame including longitudinally extending side rail members that have nominally upper and lower end portions and are laterally spaced from and parallel to each other, upper and lower cross rail members extending laterally between the side rail members and each cross rail member having opposite ends, the opposite ends of the upper cross rail member joined with the upper end portions, respectively, of the side rail members and the opposite ends of the lower cross rail member joined with the lower end portions, respectively, of the side rail members to thereby define a rigid carrier frame, said side rail members having guide tracks substantially coextensive with the length of the side rail members, at least one grid unit comprised of at least one grid module including upper and lower laterally extending parallel longitudinally spaced apart cross bars having opposite corresponding ends and laterally spaced apart longitudinally extending tie bars at each end rigidly connecting corresponding ends of the cross bars to thereby define a window opening, and said ends of the cross bars for each gird module are configured for engaging with said guide tracks at said upper ends of the side rail members to provide for sliding said grid unit in the carrier frame for being retained between the side rail members, said upper cross bar of a grid module comprising a grid unit has a cross sectional configuration defining an information strip guide channel coextensive in length with the length of said upper cross bar, the lower cross bar of said grid unit last named has a cross sectional configuration that provides for the lower cross bar of a grid module in a grid unit to be superimposed on the upper cross bar of a subjacent grid module in a grid unit installed in said carrier frame, the upper cross bar of the subjacent grid unit cooperating with said lower cross bar to provide an information strip guide channel, a surface on said upper cross bar of a grid module comprising a grid unit and a surface on a tie bar are coplanar with a surface on at least one of the side rail members when the grid is installed in the tracks of said carrier frame such that said information strip guide channel overhangs said surface and leaves the end of the channel open to permit sliding an information strip in and out of the guide channel while the grid unit is installed in the carrier frame.

5. A sign system comprising:

a carrier frame including longitudinally extending side rail members each having upper and lower end portions and the rail members are laterally spaced from and parallel to each other, upper and lower cross rails having opposite ends and extending laterally between the side rail members with the opposite ends of the upper cross rail joined with the respective upper end portions of the side rail members and opposite ends of the lower cross rail joined with the respective lower ends of the side rail members to thereby define a rigid carrier frame, said side rail members having guide tracks substantially coextensive with the length of the side rail members, upper and lower pictorial assembly retainer bars each having opposite end portions configured for sliding on said tracks of the side rail members into the carrier frame for being arranged in longitudinal space apart relationship, the uppermost retainer bar having a downwardly presented slot and the lower retainer bar having an upwardly presented slot, a pictorial assembly comprised of front and rear light transmissive panels and a transparency panel disposed between said panels, said panels having corresponding upper edges for registering in the slot of the upper retainer bar and having corresponding lower edges for registering in the slot of the lower retainer bar for holding the pictorial assembly in the carrier frame, said guide tracks on said side rail members, respectfully, are longitudinally extending guide channels defined by laterally spaced apart side walls and a back wall of the side rails spanning between the side wall members and formed therewith to leave the side opposite of the back wall open and the upper end of the channel open, said cross bars of each grid module of a grid unit and each retainer bar for the pictorial assembly having notches adjacent opposite ends thereof to define a tongue at the end of each bar for fitting slidingly into the open end of the guide track channel.

6. A sign according to claim 5 wherein the upwardly and downwardly presented slots of the respective retainer bars have unobstructed end openings adjacent at least one of the side rail members to provide for inserting and withdrawing a pictorial assembly into and from the slots, respectively, while the retainer bars remain installed in the carrier frame.

7. A sign according to claim 5 including L-shaped members each having legs arranged at substantially right angles with one leg respectively fastened to a said lower end of each side rail and the other leg fastened to one end of the lower cross rail for joining said lower cross rail to the side rail members.

8. A sign according to claim 5 including tabs extending from respectively opposite end portions of said upper cross rail, said tabs overlaying said upper end portions of said side rails, respectively, and fastened to the side rails for joining the upper cross rail and the side rails.

* * * * *